US006302007B1

(12) United States Patent
Tobler

(10) Patent No.: US 6,302,007 B1
(45) **Date of Patent: *Oct. 16, 2001**

(54) METHOD FOR TRIMMING THE EXPOSED LATERAL EDGES OF PRINTED BOUND DOCUMENTS CONVEYED INDIVIDUALLY OR IN QUIRES AND APPARATUS FOR CARRYING OUT THE METHOD

(75) Inventor: Peter Tobler, Küssnacht (CH)

(73) Assignee: Grapha-Holding AG, Hergiswill (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/964,476

(22) Filed: Nov. 4, 1997

(30) Foreign Application Priority Data

Nov. 15, 1996 (CH) ..... 19962835/96

(51) Int. Cl.[7] ..... B26D 7/06
(52) U.S. Cl. ..... 83/36; 83/733; 83/934
(58) Field of Search ..... 83/29, 39, 36, 83/607, 452, 934, 733; 412/16

(56) References Cited

U.S. PATENT DOCUMENTS

Re. 3,422 * 5/1869 Riehl ..... 83/934 X

FOREIGN PATENT DOCUMENTS

| | | | |
|---|---|---|---|
| 263992 | | 12/1949 | (CH) . |
| 669 022 | | 12/1938 | (DE) . |
| 1 266 275 | | 4/1968 | (DE) . |
| 29 11 473 | | 9/1980 | (DE) . |
| 3938285 | * | 6/1990 | (DE) ..... 83/39 |
| 0 710 530 | | 5/1996 | (EP) . |
| 1 219 826 | | 5/1960 | (FR) . |

* cited by examiner

*Primary Examiner*—Kenneth E. Peterson
(74) *Attorney, Agent, or Firm*—Darby & Darby

(57) ABSTRACT

For trimming the exposed lateral edges of printed bound documents (4 to 6) conveyed individually or in quires, such as books, brochures or magazines, which are held at the bound lateral edge (23) and conveyed to a trimming device (2) through a rotational and translational conveying movement, the trimming operation of the top and/or bottom edge is simultaneously performed on two printed documents (4 to 6) in a single operation.

1 Claim, 2 Drawing Sheets

METHOD FOR TRIMMING THE EXPOSED LATERAL EDGES OF PRINTED BOUND DOCUMENTS CONVEYED INDIVIDUALLY OR IN QUIRES AND APPARATUS FOR CARRYING OUT THE METHOD

BACKGROUND OF THE INVENTION

1. Field of the Invention

The present invention relates to a method for trimming the exposed lateral edges of printed bound documents conveyed individually or in quires, such as books, brochures or magazines, which are held at the bound lateral edge and brought to a trimming position in a processing plane which is oriented perpendicular to the trimming plane, by way of a translational conveying movement or a conveying movement of a trimming device and a rotational movement.

2. Description of the Related Art

In general, printed documents of the type described above are trimmed to the desired format at the three exposed lateral edges after the signatures forming the documents are bound or after a cover has been applied. It is also possible to trim several superimposed books together without the need for changing the clamping arrangement.

In CH-A-263,992 there is disclosed a so-called trimming device for trimming books and the like, which can be trimmed at three edges in a single clamping operation. For this purpose, a cross-bar which transversely bridges a rotating table, is positioned on a carriage and supported thereon by columns; a threaded nut is guided in the cross-bar. The threaded nut capable of moving vertically, but unable to rotate, supports a threaded spindle and has formed on its bottom side a pressure head for pressing against a pressure plate.

In this published application, there is also described a prior art rotating cutter wherein one or several books or the like are clamped on a rotating table which is supported on a carriage for movement perpendicular to the knife, wherein the three sides of the books are sequentially trimmed with a knife after each rotation of the table by 90°.

The embodiment according to the referenced CH-A-263,992 also provides the means for an application using the conventional technology described therein, wherein the rotating table can be rotated in several steps by 360°.

A trimming apparatus disclosed in EP-A-0,710,530 for trimming three lateral edges of a bound printed document includes, aside from a knife cooperating with a cutting table, cutting pliers capable of holding a printed document and provided with a positioning mechanism for holding the printed document at the bound edge, wherein the positioning mechanism can be moved translationally and rotationally relative to the knife.

Since the trimming operation is carried out in multiple steps, the trimming devices described above have disadvantages causing an extraordinarily low operating efficiency and hindering automatic loading.

It is thus an object of the present invention to provide a method and an apparatus for carrying out the method which will significantly improve the present operating efficiency while at the same time maintaining a high degree of reliability and quality.

SUMMARY OF THE INVENTION

The object is solved by the invention in that trimming of the top and/or bottom edge of two printed documents is accomplished in a single operating step. The processing can thus be carried out in part by a dual-benefit method, so that a noticeably improved processing efficiency can be attained.

For carrying out the method of the invention, there is provided an apparatus with a trimming device having a knife capable of being driven in a vertical plane of a substantially horizontal cutting table, and a positioning mechanism spaced from the cutting plane of the trimming device for conveying the printed documents held at the bound lateral edge, with the positioning mechanism capable of being driven about a rotational axis oriented perpendicular to the cutting table as well as in a stepwise fashion perpendicular to the trimming plane, the positioning mechanism further including a mounting plate of a clamping device connected to the positioning device, with the mounting plate forming a support which is co-planar with the cutting table, characterized in that the positioning mechanism has two independently controllable clamping devices facing each other with their back side at the rotational axis.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be described in conjunction with the drawing to which reference is made for all details not explicitly described in the specification. In the drawing is shown in.

DETAILED DESCRIPTION OF THE PRESENTLY PREFERRED EMBODIMENTS

Figure 1:
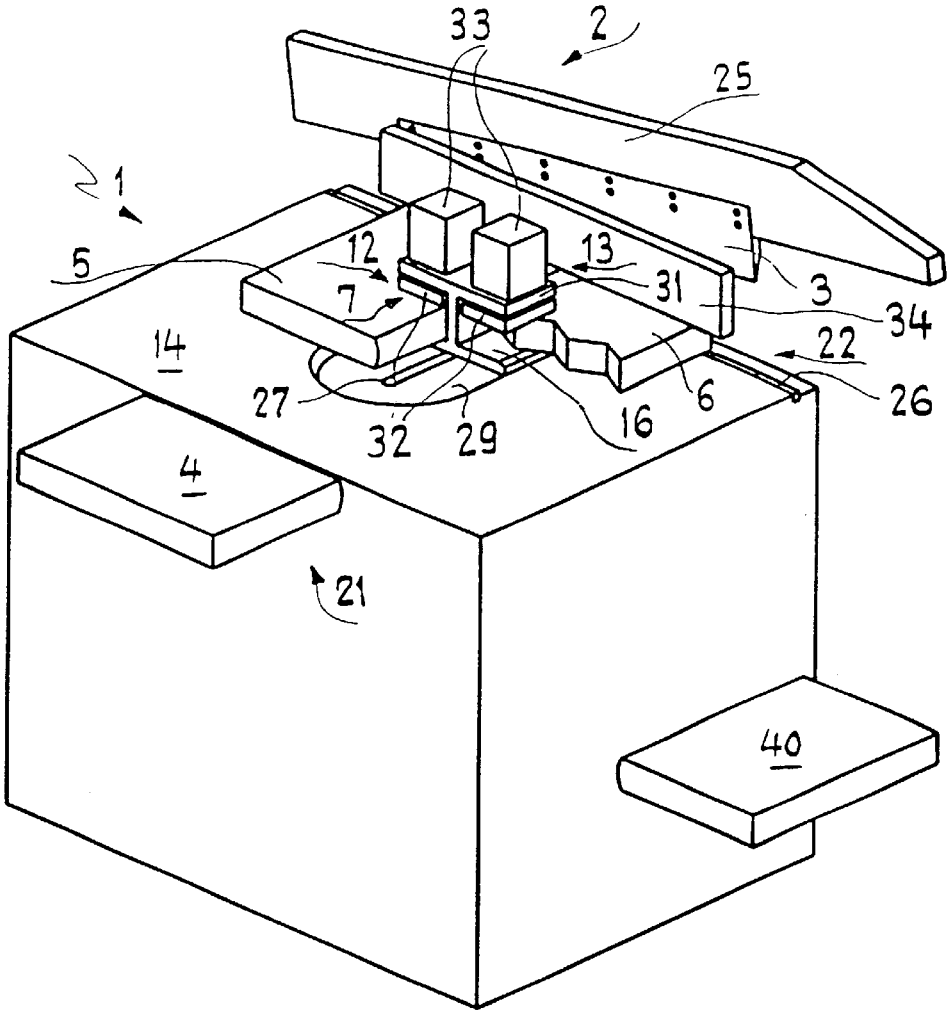
FIG. 1 a schematic representation of an embodiment of the invention.
Figure 2:
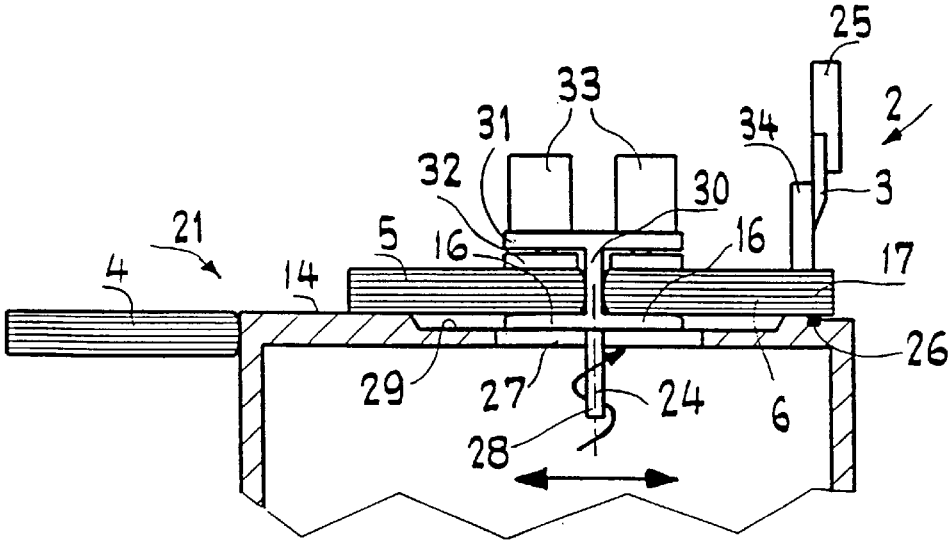
FIG. 2 a longitudinal section through the positioning mechanism depicted in FIG. 1, and FIGS. 3*a* to 3*f* a process flow according to the method of the invention.

Referring now to FIGS. 1 and 2, there is illustrated an apparatus for carrying out the method of the invention. The apparatus 1 for trimming exposed lateral edges of books, magazines, brochures and journals includes a trimming device 2 which can be driven in a vertical plane of an approximately horizontal cutting table 22. A depressable cutter bar 25 to which the knife 3 is (exchangeably) secured, performs a scissor-like movement which ends at a cutting rail 26 embedded in the cutting table 22. The cutting table 22 which forms a part of the top surface of a flat processing table 14, is laterally offset from a positioning mechanism 7 which can be driven about a rotational axis 24 which is oriented perpendicular to the top surface of the processing table 14, and back and forth perpendicularly to the cutting plane of the trimming device 2. For this purpose, the processing table 14 which rests on the floor and is supported by a stand, has a slot-like cutout 27 which is penetrated by a drive shaft 28 connected to the positioning mechanism 7. The drive motor (not shown) of the drive shaft 28 is moveably secured to a guided carriage-like frame (not visible) for movement underneath the processing table 14 parallel to the cutout 27. When viewed in the direction of the processing table 14, as shown in FIG. 1, the printed documents are trimmed by rotating the positioning mechanism 7 stepwise counterclockwise, making an angle of 90° at each step. The positioning mechanism 7 guided in the processing table 14 is provided with two clamping devices 12, 13 which face each other with their respective back sides at the rotational axis 24, for holding the printed documents 4 to 6 at their respective bound lateral edge 23.

As shown in FIGS. 1 and 2, each of the clamping devices 12, 13 includes a mounting plate 16 embedded in a recess 29 which contains the slot-like cutout 27, of the processing table 14, wherein the mounting plate 16 forms a mounting or support plane, respectively, which is flush with the processing table 14.

The planar mounting plates 16 which are located opposite from each other at the rotational axis 24, are connected to a spaced support plate 31 through a connecting land 30 which is disposed near the rotational axis 24 and oriented approximately perpendicular to the mounting plates 16. A pressure plate 32 associated with each mounting plate 16 can be displaced for defining a closed and an open position of the clamping device 12, 13. The respective side of the connecting land 30 facing the clamping devices 12, 13 forms a stop 35 representing a reference edge for the wide format for the printed documents 4 to 6 and so on, which are conveyed with their bound side first. The pressure plates 32 are actuated by the piston-cylinder units 33 which are attached to the support plates 31 and can be operated hydraulically, pneumatically, mechanically or electro-mechanically. The actuator of the piston-cylinder units 33 which are controlled by valves (not shown), is located on the guided carriage-like frame (not visible) of the drive motor of the positioning mechanism 7. As depicted in FIG. 1, two printed documents 5, 6 reside in the trimming position for the top and bottom edge, into which position the printed documents are pressed by a pressure bar 34 disposed in front of the trimming device 2 before being trimmed on the cutting table 22. The pressure bar 34 is controlled in cooperation with the trimming device 2 and the movements of the positioning mechanism 7.

The positioning mechanism 7 is loaded via the processing table 14 by a substantially straight conveying movement approximately parallel to the cutting plane of the trimming device 2, for example, with the help of a lowered pressure bar 34 or a particularly suited lateral guide.

The printed documents can be mechanically conveyed to the apparatus 1 in synchronism with the operating speed of the apparatus, for example, by an elevator which conveys the stacked printed documents 40 by an upward motion. After arriving at the processing table 14, the printed documents are individually conveyed or moved to an open clamping device 12, 13 of the positioning mechanism 7.

The processing steps of the positioning mechanism 7 are always carried out through a partial rotation about 90° and through a back and forth movement perpendicularly to the cutting plane of the knife 3 of the trimming device.

Facing the trimming device 2, there is indicated a delivery unit 21 for enabling the printed documents to exit the process.

The printed documents can also be removed from the process at a delivery unit 21 which is separated on the rotational axis 24 by 270° in the processing direction from the loading device.

The process is controlled by a programmable controller which sets a required processing speed between the clamping devices 12, 13 and positioning mechanism 7, respectively, and the trimming device 2. The processing speed has to be increased, for example, when a loading device is added.

In FIGS. 3*a* to 3*f*, there is shown—in that order—a process flow, starting with the production of three bound printed documents 4 to 6 in conjunction with an apparatus 1 depicted in FIG. 1.

Moreover, these Figures show schematically a top view of the knife 3 of a trimming device 2 and the positioning mechanism 7 of the apparatus.

Figure 3A:
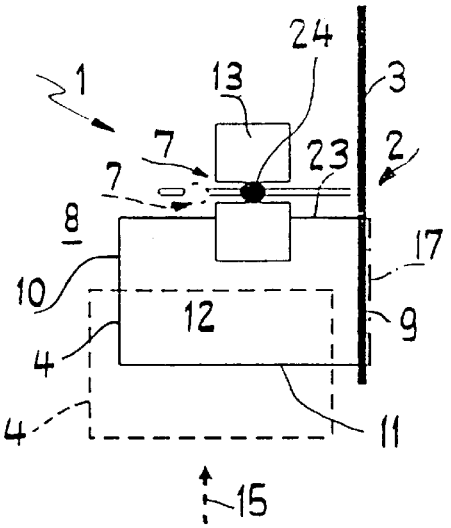

In FIG. 3*a* there is shown the initial position of the trimming process, i.e. the first printed document 4 is located in the first clamping device 12 in the position for trimming the top edge 9. Before reaching this point, the first printed document 4 was conveyed to the positioning mechanism 7 with a slight offset in a processing plane 8 or on a processing table 14, respectively, as indicated by the arrow 15 and the dashed lines, in order to prevent interference with the trimming device 2. This cautionary measure can be obviated by adapting the design of the trimming device 2 accordingly, without affecting the proposed trimming method.

When the printed document 4 is discharged, the first clamping device 12 connected to the positioning mechanism 7 is opened, so that now the mounting plate 16 of the first clamping device 12 forms a processing plane 8 with the loading plane. As long as all the printed documents 4 to 6 arrive in the first clamping device 12 in an offset position—as described above and indicated by the dashed lines—, the transport path to the trimming device 2 is longer than would otherwise be necessary if the printed documents were to arrive at one of the clamping devices 12, 13 in a straight path, i.e. offset only by the section 17 to be trimmed. FIG. 3*a* furthermore shows the clamped printed document 4 in the cutting region.

Figure 3D:
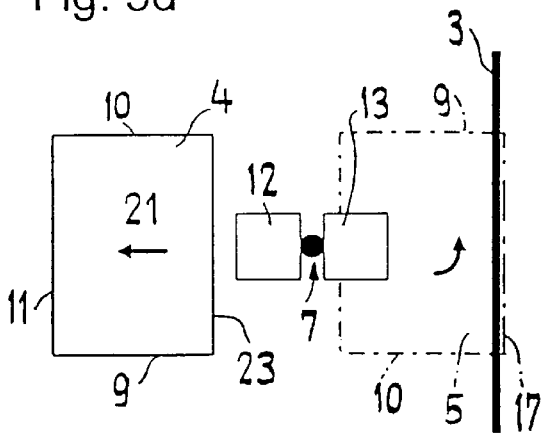
Figure 3B:
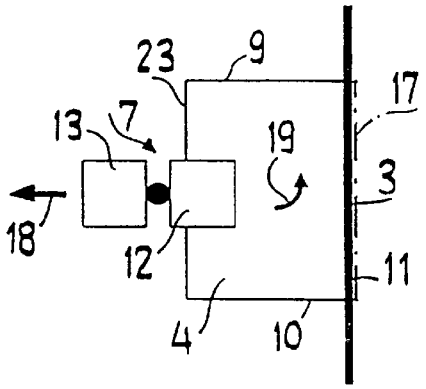

After the section 17 is separated by a cutting action of the knife 3, the printed document 4 which was clamped during the entire process, is rotated by 90° in the processing plane 8 after the knife 3 is lifted, and placed in a position where the front side can be trimmed. In this step, the width of the printed document 4 is important since it determines the length of the path to be traveled perpendicular to the knife 3 or the trimming plane. The travel path required for trimming the front edge 11 of the printed document 4 may accidentally be equal to zero. In this situation, the printed document 4 or the positioning mechanism 7, respectively, will have to be set back from the knife 3 depending on the ratio of the longitudinal and lateral edge of the printed document. In FIG. 3*b*, the translational movement is indicated by the arrow 18, the rotation about 90° by the arrow 19.

Figure 3E:
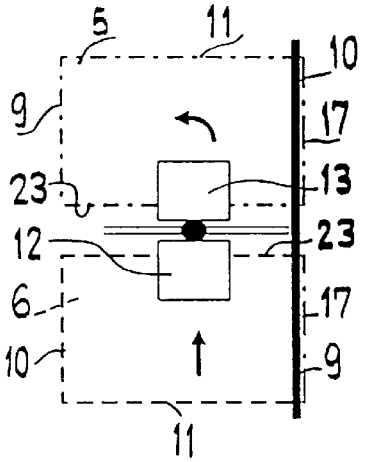
Figure 3C:
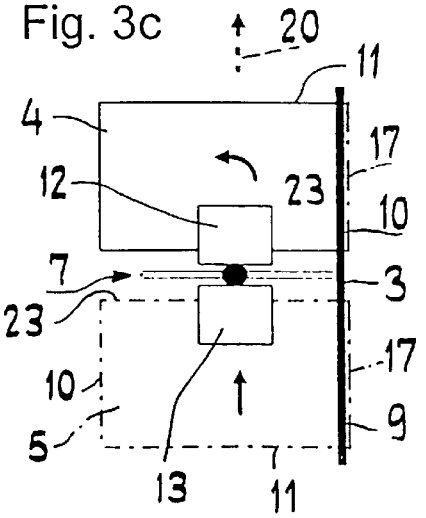

A subsequent processing step is depicted in FIG. 3*c*. After lifting the knife 3, the first printed document 4 was rotated by additional 90°, while the positioning mechanism 7 was placed in a position to enable the second clamping device 13 to accept the immediately following printed document 5. The two printed documents 4, 5 are moved concurrently by a translational movement to the cutting region where their lateral edges are trimmed; here, the bottom edge 10 of the printed document 4 and the top edge 9 of the printed document 5 are trimmed, if both printed documents 4, 5 are conveyed to the first 12 and the second clamping device 13, respectively, with the same orientation—namely with the bound edge first. The two arrows in FIG. 3*c* indicate the previously executed movement of the printed documents 4, 5 which are distinguished by solid 4 and dot-dashed lines 5. After this processing step, the first printed document 4 is completed and able to leave the apparatus 1 along arrow 20. In the apparatus 1 shown in FIG. 3*d*, however, the delivery unit referenced by the arrow 21 is in the 9 o'clock position; FIG. 3*d* shows trimming of the front edge 11 of the second printed document 5 and removal of the first printed document 4 from the clamping device 12. The trimming step on printed document 5 corresponds essentially to the trimming step on printed document 4 as depicted in FIG. 3*b*.

According to FIG. 3*e*, the positioning mechanism 7 is hereafter placed in a position where it is capable of receiving the third and the immediately following printed document 6, respectively, by way of the (first) clamping devices 12. The situation shown in FIG. 3*e* is essentially a repetition of that shown in FIG. 3*c*.

Figure 3F:
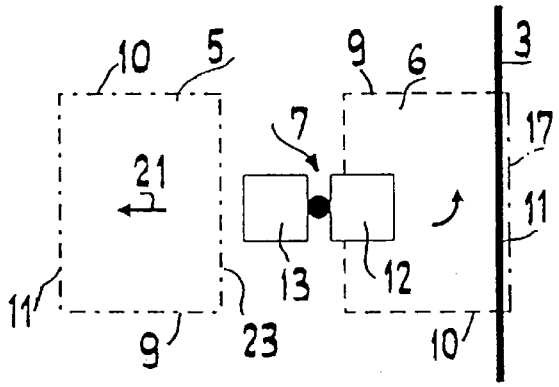

In FIG. 3*f*, the process of FIG. 3*d* is repeated with the printed documents 5 and 6.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for trimming exposed lateral edges of a plurality of printed materials, comprising at least a first printed material, a second printed material and a third printed material, each printed material includes a bound edge, a top edge, a bottom edge and a front edge, the method comprising the steps of (a) bringing the first printed material into a first mounting plate of a rotatable clamping device;

(b) positioning and clamping the bound edge of the first printed material into a position for trimming the top edge;

(c) rotating the clamping device including the clamped first printed material by a first 90° for trimming the front edge;

(d) rotating the clamping device including the clamped first printed material by a second 90° and positioning the bottom edge for trimming;

(e) bringing the second printed material into a second mounting plate of the rotatable clamping device;

(f) positioning and clamping the second printed material into a position for trimming the top edge, and trimming the top edge of the second printed material and the bottom edge of the first printed material simultaneously;

(g) rotating the clamping device including the clamped first printed material by a third 90° for trimming the front edge of the second printed material and releasing the first printed material from the clamping device and removing the first printed material from the first mounting plate;

(h) rotating the clamping device including the clamped second printed material by a fourth 90°;

(i) bringing the third printed material into the first mounting plate of the rotatable clamping device;

(j) positioning and clamping of the third printed material into a position for trimming the top edge of the third printed material and the bottom edge of the second first printed material simultaneously.

* * * * *